US009567686B2

(12) United States Patent
Shibata et al.

(10) Patent No.: US 9,567,686 B2
(45) **Date of Patent: *Feb. 14, 2017**

(54) ALUMINUM OXIDE FILM REMOVER AND METHOD FOR SURFACE TREATMENT OF ALUMINUM OR ALUMINUM ALLOY

(75) Inventors: Toshiaki Shibata, Hirakata (JP); Yoshihito Ii, Hirakata (JP); Hiromu Inagawa, Hirakata (JP)

(73) Assignees: C. UYEMURA & CO., LTD., Osaka-shi (JP); FUJI ELECTRIC CO., LTD., Kawasaki-shi (JP)

( * ) Notice: Subject to any disclaimer, the term of this patent is extended or adjusted under 35 U.S.C. 154(b) by 743 days.

This patent is subject to a terminal disclaimer.

(21) Appl. No.: 13/167,075

(22) Filed: Jun. 23, 2011

(65) Prior Publication Data

US 2011/0315658 A1 Dec. 29, 2011

(30) Foreign Application Priority Data

Jun. 23, 2010 (JP) ..... 2010-142787
May 12, 2011 (JP) ..... 2011-106928

(51) Int. Cl.

| | |
|---|---|
| ***C23C 18/16*** | (2006.01) |
| ***C25D 5/44*** | (2006.01) |
| ***C23C 18/18*** | (2006.01) |
| ***C23C 18/54*** | (2006.01) |
| ***C23G 1/22*** | (2006.01) |
| *C23C 18/00* | (2006.01) |

(52) U.S. Cl.

CPC ..... *C25D 5/44* (2013.01); *C23C 18/1601* (2013.01); *C23C 18/1635* (2013.01); *C23C 18/1651* (2013.01); *C23C 18/18* (2013.01); *C23C 18/1824* (2013.01); *C23C 18/54* (2013.01); *C23G 1/22* (2013.01)

(58) Field of Classification Search

CPC ..... C23C 18/1601; C23C 18/1635; C23C 18/1651; C23C 18/1824; C23C 18/54; C23C 18/18

USPC ..... 148/275

See application file for complete search history.

(56) References Cited

U.S. PATENT DOCUMENTS

| | | | | |
|---|---|---|---|---|
| 6,080,447 | A | 6/2000 | Ferroni et al. | |
| 2008/0169267 | A1 | 7/2008 | Uchida et al. | |
| 2011/0052835 | A1* | 3/2011 | Minsek | C23C 18/14 427/581 |

FOREIGN PATENT DOCUMENTS

| | | | |
|---|---|---|---|
| JP | 05-065657 | A | 3/1993 |
| JP | 11-087392 | A | 3/1999 |
| JP | 2002-151537 | A | 5/2002 |

(Continued)

*Primary Examiner* — Lois Zheng

(74) *Attorney, Agent, or Firm* — Westerman, Hattori, Daniels & Adrian, LLP

(57) ABSTRACT

Disclosed herein is an aluminum oxide film remover for removing an oxide film on the surface of aluminum or aluminum alloy, which comprises silver ions and/or copper ions, a solubilizing agent for silver ions and/or copper ions, and a quaternary ammonium hydroxide compound, and has a pH value of 10 to 13.5. A method for surface treatment of aluminum or aluminum alloy is also disclosed, which comprises immersing a workpiece having aluminum or aluminum alloy at least on the surface thereof in the aluminum oxide film remover, and depositing the silver and/or copper contained in the remover on the surface of aluminum or aluminum alloy while removing the aluminum oxide film.

15 Claims, 2 Drawing Sheets

(56) References Cited

FOREIGN PATENT DOCUMENTS

| | | | |
|---|---|---|---|
| JP | 2002-514683 | A | 5/2002 |
| JP | 2004-263267 | A | 9/2004 |
| JP | 2004-346405 | A | 12/2004 |
| JP | 2008-169446 | A | 7/2008 |

* cited by examiner

ALUMINUM OXIDE FILM REMOVER AND METHOD FOR SURFACE TREATMENT OF ALUMINUM OR ALUMINUM ALLOY

CROSS-REFERENCE TO RELATED APPLICATION

This non-provisional application claims priority under 35 U.S.C. §119(a) on Patent Application Nos. 2010-142787 and 2011-106928 filed in Japan on Jun. 23, 2010 and May 12, 2011, respectively, the entire contents of which are hereby incorporated by reference.

TECHNICAL FIELD

The present invention relates to an aluminum oxide film remover and a method for surface treatment of aluminum or aluminum alloy. More particularly, the present invention relates to an aluminum oxide film remover which is effective for a pretreatment employed to form UBM (under bump metal) or bumps on the wafer by plating, and it also relates to a method for surface treatment of aluminum or aluminum alloy.

BACKGROUND ART

There have previously been employed several methods for forming UBM or bumps on the silicon wafer. They include one which comprises performing a zinc substitution treatment to form a zinc film on an aluminum thin film electrode patterned on a wafer and performing electroless nickel plating thereon to form bumps; one which comprises performing a palladium treatment in place of the zinc substitution treatment and performing electroless nickel plating, thereby forming bumps; and one which comprises substituting a surface of an aluminum thin film electrodes directly with nickel and performing self-catalyzed electroless nickel plating to form bumps.

Any of these methods involves pretreatment before formation of UBM or bumps. This pretreatment generally comprises a degreasing treatment of the aluminum thin film electrodes and a treatment for removing an aluminum oxide film or metal impurities on the aluminum thin film electrodes. In this case, if an extremely thin film of aluminum oxide formed by immersion in nitric acid or the like is present, a subsequent plating step can be preformed directly without problem. However, if a strong aluminum oxide film remains on the surface after shaving or annealing, or if a specific crystal orientation plane exists on the aluminum surface, a plating film formed in subsequent steps will be poor in adhesion, or will be perforated. At worst, a plating film will not be formed on the surface. Such a strong aluminum oxide film is desired to be completely removed beforehand. Regarding the specific crystal orientation plane of the aluminum surface, the aluminum surface should be uniformly prepared.

In order to address the foregoing problem, there has been proposed a method for preparing the ground for plating by dry process without dissolving an aluminum oxide film (see Patent Document 1: JP-A 11-87392). However, this method still has room for improvement in terms of a complicated process, disadvantages in promptness and production costs. Moreover, the method has a problem that the electrical insulation of the remaining oxide film leads to an increased thermal resistance, resulting in deterioration of electrical characteristics.

It has been common practice to remove the strong aluminum oxide film by dipping in a strong alkaline or acid solution which dissolves not only an aluminum oxide film but also an aluminum or aluminum alloy base. This practice is applicable only if the base is sufficiently thick but is inapplicable if the aluminum or aluminum alloy is as thin as 0.5 or 1.0 m, in which case the etching margin is limited.

There have been proposed other methods, such as one which employs an organic solvent (see Patent Document 2: JP-A 2002-151537) and one which employs a mixture of several acids (see Patent Document 3: JP-A 5-65657, and Patent Document 4: JP-A 2002-514683).

These methods, however, involve difficulties in establishing adequate treatment conditions since the base material is inevitably etched excessively and where the base material is a thin film, the thin film may be disappeared or dissolved. Moreover, a conventional grinding or mechanical polishing cannot be adopted for the thin film, unlike the case of die casting. Hence, the oxide film formed by heat treatment in the fabricating process remains on the surface of the aluminum thin film, which worsens the problem.

In order to solve the foregoing problem, there has been proposed a remover which contains a salt or oxide of a metal capable of substituting aluminum, a solubilizing agent for the metal ions, an alkali and preferably a surfactant, with a pH value of 10 to 13.5 (see Patent Document 5: JP-A 2008-169446). This remover, when applied to an aluminum oxide film that has formed on aluminum or aluminum alloy, can rapidly remove the aluminum oxide film at a low temperature with minimum corrosion to the surface of aluminum or aluminum alloy.

That is to say, the reason of the severe corrosion of the base of aluminum or aluminum alloy when the conventional acid-based treating solution is applied to remove an aluminum oxide film is that there has been no effective method to deal with the difference between reactivity of aluminum oxide film with acid and reactivity of aluminum ground or aluminum alloy ground with acid.

JP-A 2008-169446 (Patent Document 5) discloses that an aluminum oxide film can be effectively removed by an alkaline remover comprising a salt or oxide of a metal capable of substituting aluminum and a solubilizing agent for the metal ions, as the result of investigation to dissolve and remove the aluminum oxide film while avoiding the high reactivity of a aluminum ground or aluminum alloy ground with acid.

FIG. 2 is a schematic sectional view showing the method in which the conventional alkaline remover removes an aluminum oxide film on the surface of aluminum or aluminum alloy. FIGS. 2(1) to 2(6) represent each step of removing an aluminum oxide film on the surface of aluminum or aluminum alloy, respectively. Incidentally, the reference numerals 1, 2, 3, and 4 in FIG. 2 denote aluminum or aluminum alloy having the (111) plane, aluminum or aluminum alloy having the (100) plane, an aluminum oxide film, and a metal derived from the additive metal capable of substituting aluminum, respectively.

The procedure starts with immersing aluminum or aluminum alloy having the aluminum oxide film 3 formed thereon in the conventional alkaline remover (containing zinc as the additive metal), as shown in FIG. 2(1), so that the aluminum oxide film 3 is removed, as shown in FIG. 2(2). As the result, the aluminum or aluminum alloy exposes itself. The aluminum or aluminum alloy 1 having the (111) plane, however, is subjected to a rapid substitutional deposition of the metal 4 on its surface, which is derived from the additive metal contained in the alkaline remover, as shown in FIG. 2(3).

The metal derived from the additive metal does not deposit substitutionally on the aluminum oxide film 3 because aluminum in the aluminum oxide film 3 has already ionized. Moreover, the aluminum or aluminum alloy 1 having the (111) plane is exempt from corrosion because it is protected by the deposited metal 4 formed on the exposed area. As this reaction proceeds, the deposited metal 4, which is derived from the additive metal capable of substituting aluminum, continues to deposit on the surface of aluminum or aluminum alloy 1 having the (111) plane which has exposed itself as the aluminum oxide film 3 is dissolved, as shown in FIG. 2(4). Eventually, the aluminum oxide film 3, which has existed on the surface of aluminum or aluminum alloy 1, is completely dissolved and removed. At the same time, the surface of aluminum or aluminum alloy is entirely covered with the deposited metal 4 which is derived from the additive metal capable of substituting aluminum, as shown in FIG. 2(5). The deposited metal 4 can be removed by acid cleaning, as shown in FIG. 2(6).

In other words, as shown in FIG. 2, the alkaline remover disclosed in JP-A 2008-169446 (Patent Document 5) does not corrode the aluminum ground or the aluminum alloy ground because it causes the deposited metal to cover immediately the aluminum base or the aluminum alloy base having the (111) plane which has been exposed by etching. Moreover, it continues to effectively remove the aluminum oxide film because its action to dissolve the aluminum oxide film is not impeded by the increasing concentration of aluminum hydroxide associated with dissolution of the aluminum base or the aluminum alloy base.

The alkaline remover offers another advantage of capability of accomplishing a treatment in a shorter time at a lower temperature than acid removers because it contains a large number of hydroxide ions ($OH^-$) which can readily dissolve an aluminum oxide film.

Unfortunately, when the conventional alkaline remover is applied to the aluminum or aluminum alloy 2 having the (100) plane, substitution by the additive metal does not readily take place on its surface. In other words, only the dissolution of aluminum proceeds and substitution by the additive metal (zinc) shown in FIGS. 2(3) and 2(4) does not take place. Thus, the surface becomes smooth as shown in FIGS. 2(5) and 2(6). As the result, there is a problem that zinc substitution does not take place on the (100) plane in the subsequent process.

In the long run, the conventional alkaline remover brings about etching alone without substitution of aluminum by the additive metal on the specific crystal orientation plane (or the (100) plane). The result is that zinc substitution of aluminum does not take place on that crystal orientation plane in the subsequent processing, i.e., a lack of zinc substitution develops. The lack of zinc substitution causes the subsequent nickel plating to give defective nickel film, which is poor in adhesion and which is partly perforated. Such a defective nickel film is detrimental to electrical conductivity and appearance.

Listed below are prior art documents concerning the present invention.

CITATION LIST

Patent Document 1: JP-A 11-87392
Patent Document 2: JP-A 2002-151537
Patent Document 3: JP-A 5-65657
Patent Document 4: JP-A 2002-514683
Patent Document 5: JP-A 2008-169446
Patent Document 6: JP-A 2004-263267
Patent Document 7: JP-A 2004-346405

SUMMARY OF THE INVENTION

The present invention was completed to address the foregoing problems. An object of the present invention is to provide an aluminum oxide film remover and a method for surface treatment of aluminum or aluminum alloy using the remover. The remover according to the present invention is designed to be applied to an aluminum base material for uniform etching on any crystal orientation plane without only the specific orientation crystal plane (or the (100) plane) being etched. Etching in this method permits the subsequent process to form a uniform zinc-substituted film without a lack of zinc substitution.

The present inventors have earnestly studied in order to attain the above object. As a result, it has been found that a remover decreases in attackability to aluminum or aluminum alloy when it contains a quaternary ammonium hydroxide compound as an alkali.

More specifically, it has been found that when an aluminum oxide film is treated with a remover containing silver ions and/or copper ions, a solubilizing agent of the silver ions and/or copper ions, a quaternary ammonium hydroxide compound as an alkali and optionally a surfactant and/or zinc ions and having a pH value of 10 to 13.5, such a remover can rapidly remove the oxide film and to perform uniform etching on the aluminum ground having the specific crystal orientation plane without the aluminum ground being excessively etched and with the surface of aluminum or aluminum alloy being protected from corrosion. Thus, the present invention was completed.

Accordingly, the present invention provides an aluminum oxide film remover and a method for surface treatment of aluminum or aluminum alloy, which are defined by the following aspects.

Aspect 1:

An aluminum oxide film remover for removing an oxide film on the surface of aluminum or aluminum alloy, comprising silver ions and/or copper ions, a solubilizing agent for silver ions and/or copper ions, and a quaternary ammonium hydroxide compound, said remover having a pH value of 10 to 13.5.

Aspect 2:

The aluminum oxide film remover of Aspect 1, further comprising a surfactant.

Aspect 3:

The aluminum oxide film remover of Aspect 1, further comprising zinc ions.

Aspect 4:

A method for surface treatment of aluminum or aluminum alloy, comprising:

immersing a workpiece having aluminum or aluminum alloy at least on the surface thereof in the aluminum oxide film remover of any one of Aspects 1 to 3; and depositing the silver and/or copper contained in the remover on the surface of aluminum or aluminum alloy while removing the aluminum oxide film.

Aspect 5:

The method for surface treatment of aluminum or aluminum alloy of Aspect 4, wherein the workpiece is one which has an aluminum film or an aluminum alloy film formed on the surface of a non-aluminum material.

Aspect 6:

The method for surface treatment of aluminum or aluminum alloy of Aspect 4, wherein the step of depositing silver and/or copper is followed by an additional step of forming a plating layer thereon.

Aspect 7:

The method for surface treatment of aluminum or aluminum alloy of Aspect 4, wherein the step of depositing silver and/or copper is followed by an additional step of removing the deposited metal by means of an acid solution having oxidizing properties.

Aspect 8:

The method for surface treatment of aluminum or aluminum alloy of Aspect 7, wherein the step of removing the deposited metal by means of an acid solution having oxidizing properties is followed by a step of subjecting the aluminum or aluminum alloy to a zinc substitution treatment or a palladium treatment, and a subsequent step of plating.

Aspect 9:

The method for surface treatment of aluminum or aluminum alloy of Aspect 7, wherein the step of removing the deposited metal by means of an acid solution having oxidizing properties is followed by a step of plating directly on the aluminum or aluminum alloy.

JP-A 2008-169446 (Patent Document 5) discloses a remover for an oxide film which contains a quaternary ammonium hydroxide compound and a metal other than silver and copper (such as zinc, manganese, gold, nickel, and palladium). A workpiece is treated with the remover by immersion, and the deposited metal formed thereon is removed by means of an acid solution having oxidizing properties. However, the resulting workpiece does not undergo zinc substitution sufficiently by a zinc substitution treatment. Therefore, a nickel plating processing that follows the step using the foregoing oxide film remover will lead to a defective plating. However, if an aluminum oxide film remover containing a quaternary ammonium hydroxide compound is incorporated with silver ions and/or copper ions, such a remover can prepare an aluminum surface which can easily undergo zinc substitution, and sufficient zinc substitution thereon is achieved in the subsequent zinc substitution treatment. For this reason, a good nickel film can be formed in the subsequent nickel plating process.

FIG. 1 is a schematic sectional view showing the method in which the alkaline remover of the present invention removes an aluminum oxide film on the surface of aluminum or aluminum alloy. FIGS. 1(1) to 1(6) represent each step of removing an aluminum oxide film on the surface of aluminum or aluminum alloy, respectively. Incidentally, the reference numerals 1, 2, 3, and 4 in FIG. 1 denote aluminum or aluminum alloy having the (111) plane, aluminum or aluminum alloy having the (100) plane, an aluminum oxide film, and a metal derived from the additive metal capable of substituting aluminum, respectively.

The procedure starts with immersing aluminum or aluminum alloy having an aluminum oxide film 3 formed thereon in the alkaline remover of the present invention (containing silver and/or copper as the additive metal), as shown in FIG. 1(1), so that the aluminum oxide film 3 is removed, as shown in FIG. 1(2). As in the case where a conventional alkaline remover is used, the alkaline remover of the present invention dissolves the aluminum oxide film 3 so that the aluminum or aluminum alloy 1 having the (111) plane exposes itself. On the thus exposed surface deposits the metal 4 (silver and/or copper) derived from the additive metal capable of substituting aluminum, as shown in FIGS. 1(3) and 1(4). Eventually, the aluminum oxide film 3, which have been present on the surface of aluminum or aluminum alloy 1, is completely dissolved and removed. On the other hand, the surface of aluminum or aluminum alloy is entirely covered with the deposited metal 4 (silver and/or copper) derived from the additive metal capable of substituting aluminum, as shown in FIG. 1(5). The deposited metal 4 can be removed by acid cleaning, as shown in FIG. 1(6).

Unlike a conventional alkaline remover, the alkaline remover of the present invention acts on the aluminum or aluminum alloy 2 having the (100) plane as well as aluminum or aluminum alloy 1 having the (111) plane, thereby allowing the deposited metal 4 (silver and/or copper) derived from the additive metal capable of substituting aluminum to deposit on their surface, as shown in FIG. 1(3). Consequently, it permits the deposited metal 4 (silver and/of copper) to deposit thereon sequentially without dissolving only aluminum, as shown in FIG. 1(4). In this way, the aluminum oxide film 3 which has existed on the surface of aluminum or aluminum alloy 2 is completely dissolved and removed, and the surface of aluminum or aluminum alloy 2 is covered with the deposited metal 4 (silver and/or copper) derived from the additive metal capable of substituting aluminum, as shown in FIG. 1(5). As in the case mentioned above, the deposited metal 4 (silver and/or copper) can also be removed by acid cleaning, as shown in FIG. 1(6).

In the technical field concerning the present invention, it has been necessary to carry out the zinc substitution treatment twice in order to form a compact zinc film. However, it has been revealed that the remover of the present invention forms a sufficiently compact zinc film with only single zinc substitution treatment.

In other words, the remover of the present invention, which contains silver ions and/or copper ions, can dissolve and remove rapidly and continuously the aluminum oxide film by wet process with minimum corrosion on the aluminum or aluminum alloy ground, and it can also achieve uniform etching on any aluminum material having a specific crystal orientation plane.

Advantageous Effects of the Invention

The remover according to the present invention substitutionally deposits silver and/or copper, which is derived from the silver compound and/or copper compound contained therein, on the surface of aluminum or aluminum alloy while protecting its corrosion as far as possible. In addition, the silver and/or copper that has substitutionally deposited can be rapidly removed at a low temperature with very little corrosion on the surface of aluminum or aluminum alloy. Therefore, even in the case of aluminum or aluminum alloy having a very small thickness, the remover activates the surface of aluminum or aluminum alloy while allowing the aluminum or aluminum alloy to remain certainly. The surface treatment method according to the present invention is particularly suitable to activate the surface of an aluminum thin film electrode formed on a silicon wafer.

Moreover, the remover according to the present invention contains silver ions and/or copper ions, so that it prepares an aluminum surface which can easily undergo zinc substitution in the subsequent zinc substitution step, thereby forming a compact zinc film. In addition, the remover according to the present invention additionally contains a quaternary ammonium hydroxide compound, which protects the aluminum ground from excessive etching. The remover of the present invention permits a good nickel plating film to be formed in the subsequent nickel plating process with only single zinc substitution treatment.

DESCRIPTION OF THE EMBODIMENT

Figure 1:
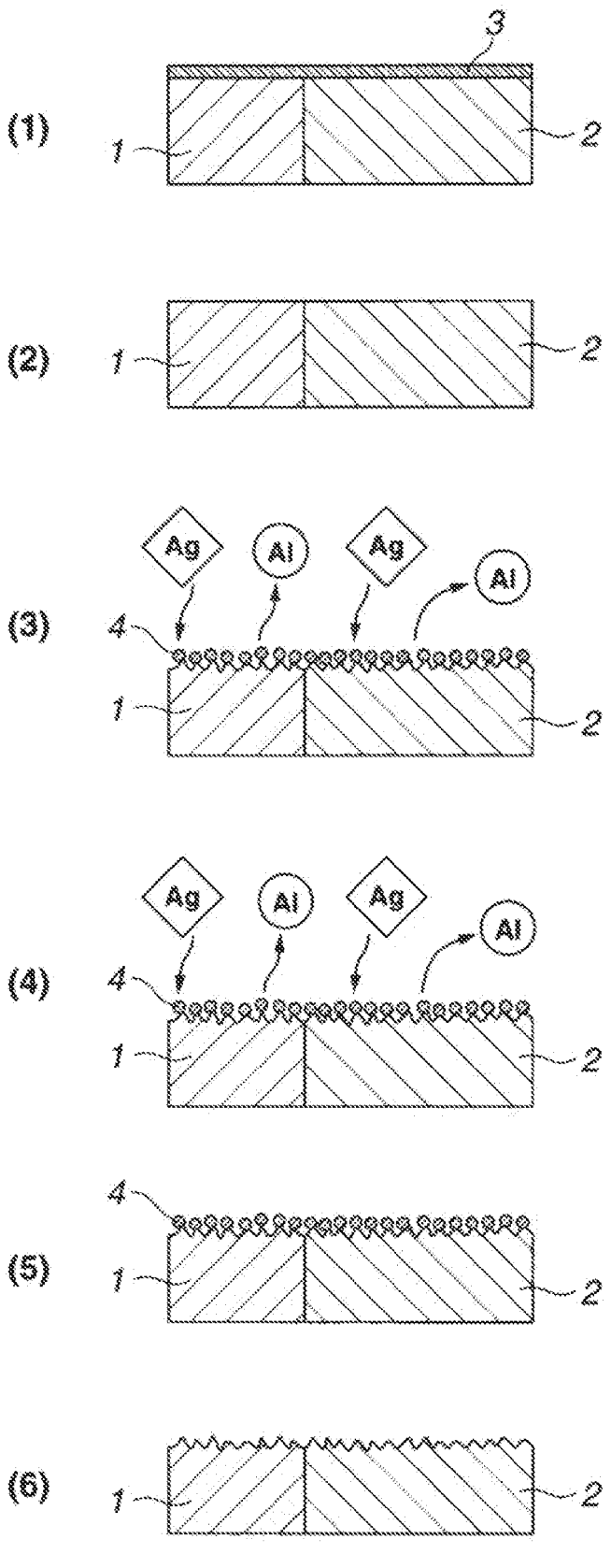
FIG. 1 is a schematic sectional view showing the method in which the alkaline remover of the present invention removes an aluminum oxide film on the surface of aluminum or aluminum alloy.
Figure 2:
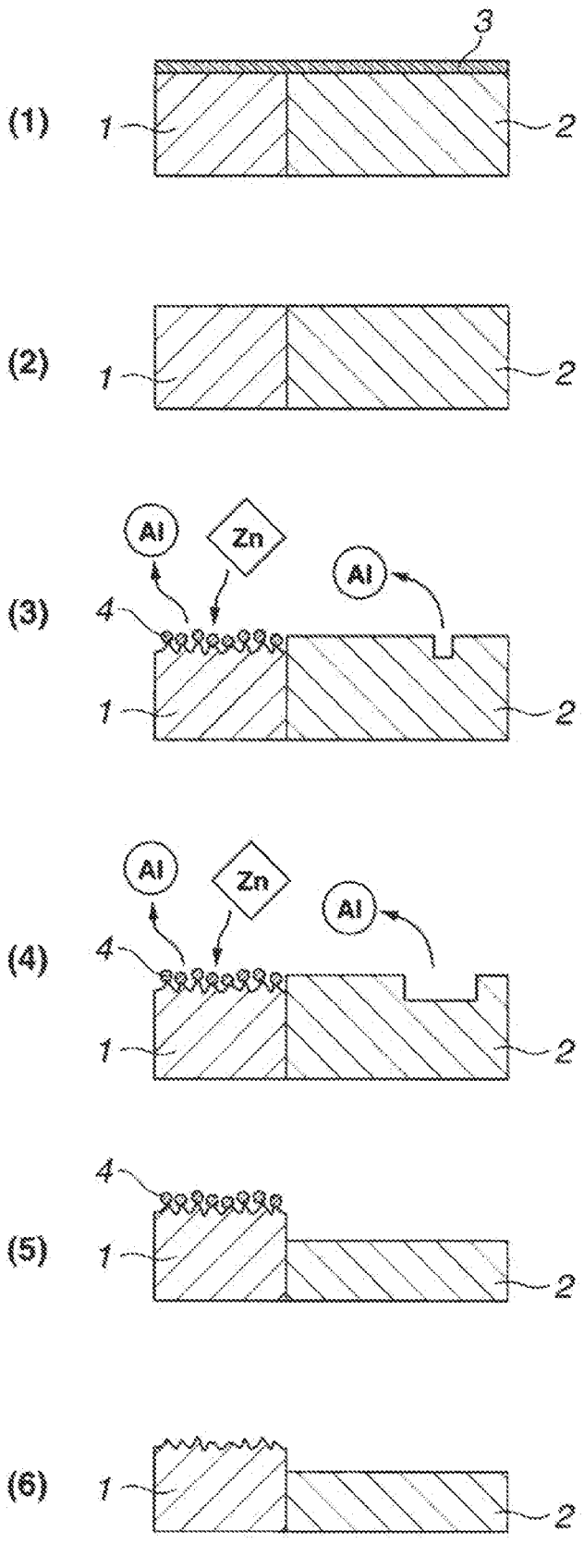
FIG. 2 is a schematic sectional view showing the method in which the conventional alkaline remover removes an aluminum oxide film on the surface of aluminum or aluminum alloy.

The following is a detailed description of the present invention.

The aluminum oxide film remover according to the present invention contains silver ions and/or copper ions, a solubilizing agent of the silver ions and/or copper ions, and a quaternary ammonium hydroxide compound, having a pH value of 10 to 13.5.

The aluminum oxide film remover according to the present invention contains silver ions and/or copper ions, which prepare an aluminum surface that easily undergo zinc substitution after treatment therewith. This is because the step of removing oxide film causes silver and/or copper to deposit on the aluminum surface and the subsequent step for removing silver and/or copper causes a surface with fine roughness to expose itself.

Examples of the compounds providing silver ions include, but are not limited to, silver nitrate, silver chloride, silver bromide, silver iodide, silver acetate, silver carbonate, silver vanadate, silver sulfate, silver thiocyanate, silver tetrafluoroborate, silver p-toluenesulfonate, silver trifluoroacetate, and silver trifluoromethanesulfonate. Examples of the compounds providing copper ions include, but are not limited to, copper(II) acetate, copper(II) nitrate, copper(I) iodide, copper(I) chloride, copper(II) chloride, copper(I) oxide, copper (II) oxide, copper(II) sulfate, copper(I) sulfide, copper(II) sulfide, copper(I) thiocyanate, copper(II) tetrafluoroborate, copper(II) pyrophosphate, and copper(II) formate. These silver and/or copper compounds may be used alone or in combination with two or more.

The silver ions and/or copper ions are not specifically restricted in concentration; however, the concentration is preferably 0.1 to 5,000 ppm, more preferably 1 to 2,000 ppm. A concentration lower than 0.1 ppm may be not enough to remove oxide film completely, with residual oxide film causing poor plating. A concentration higher than 5,000 ppm may lead to a decrease in bath stability.

The remover of the present invention also contains a solubilizing agent (or a complexing agent) that solubilizes the silver ions and/or copper ions contained therein. This agent is not specifically restricted, but may be an ordinary complexing agent or a chelating agent. Examples of the solubilizing agent includes aminocarboxylic acids and salts thereof such as ethylenediaminetetraacetic acid, nitrilotriacetic acid, hydroxyethylethylenediaminetriacetic acid, diethylenetriaminepentaacetic acid, and polyaminocarboxylic acid; phosphonic acids and salts thereof such as 1-hydroxyethylidenebisphosphonic acid (HEDP), aminotrimethylphosphonic acid, and ethylenediaminetetramethylphosphonic acid; amines and salts thereof such as ethylenediamine, diethylenetriamine, and triethylenetetramine; hydantoin compounds; barbituric acid compounds; and imide compounds. Of these, as solubilizing agents for silver ions, hydantoin compounds and barbituric acid compounds are preferred especially from the standpoint of bath stability. As solubilizing agents for copper ions, ethylenediaminetetraacetic acid and hydroxyethylethylenediaminetriacetic acid are preferred. They may be used alone or in combination with two or more.

The solubilizing agent contained in the remover of the present invention is not specifically restricted in concentrations. The concentration is preferably 0.01 to 50 g/L, more preferably 0.1 to 30 g/L. A concentration lower than 0.1 g/L may lead to a decrease in bath stability, and a concentration higher than 50 g/L may cause a poor appearance of plating.

The remover of the present invention contains a quaternary ammonium hydroxide compound as an alkaline compound. The quaternary ammonium hydroxide compound acts to reduce attackability to aluminum or aluminum alloy because it is slow in etching an aluminum oxide film compared with alkali metal hydroxide.

The quaternary ammonium hydroxide compound is preferably one which has an alkyl group and/or hydroxyalkyl group of 1 to 4 carbon atoms. Typical examples of the compounds include tetramethylammonium hydroxide (TMAH), tetraethylammonium hydroxide, tetrapropylammonium hydroxide, tetrabutylammonium hydroxide, trimethyl(2-hydroxyethyl)ammonium hydroxide (or choline), and triethyl(2-hydroxyethyl)ammonium hydroxide, but are not limited thereto. Preferable of these examples are tetramethylammonium hydroxide (TMAH) and trimethyl(2-hydroxyethyl)ammonium hydroxide (or choline) in the viewpoints of removal effectiveness of oxide films, stability, and cost.

The quaternary ammonium hydroxide compound is added in an amount sufficient to make the remover have a pH value of 10 to 13.5, preferably 11 to 13, as specified.

The remover of the present invention may contain a surfactant that imparts wettability thereto. Examples of the surfactants include, but are not limited to, nonionic ones such as polyethylene glycol, polyoxyethylene ether, polyoxyethylene alkyl ether, and a polyoxyethyleneoxy-propylene block copolymer; anionic ones such as a fatty acid sodium salt, sodium alkylsulfate, and sodium alkylethersulfate; and cationic ones such as an alkyltrimethylammonium salt and a dialkyldimethylammonium salt. Of these, nonionic and anionic surfactants are preferred for uniform treatment. They may be used alone or in combination with two or more.

When using polyethylene glycol as the surfactant, its molecular weight is not particularly limited, and is normally not less than 100, preferably not less than 200, and is normally not more than 20,000, preferably not more than 6,000. With an excessively high molecular weight, it may be poor in solubility, and with an excessively low molecular weight, it may not impart wettability as desired. Incidentally, polyethylene glycol may be commercially available, and its molecular weight may be measured according to the method specified in Japanese Pharmacopoeia.

The surfactant in the remover is not specifically restricted in concentration. Its concentration is normally not lower than 1 ppm (mg/L), preferably not lower than 10 ppm (mg/L), and is normally not higher than 5,000 ppm (mg/L), preferably not higher than 2,000 ppm (mg/L). With an excessively low concentration, it may not impart wettability as desired, and with an excessively high concentration, it may cause the deposited metal to deposit on other members than aluminum or aluminum alloy.

The remover of the present invention may preferably be prepared in the form of aqueous solution for safety in operation. It is also possible to use water-soluble organic solvents such as methanol, ethanol and isopropyl alcohol (IPA), and mixed solvents with water. These solvents may be used alone or in combination with two or more.

The remover of the present invention has a pH value of 10 to 13.5, preferably 11 to 13. With its pH value adjusted to alkaline pH value, the remover easily attacks an aluminum oxide film and achieves a treatment in a short time. If the remover has a pH value lower than 10, a dissolution rate of an oxide film is remarkably low. With its pH value higher than 13.5, the remover dissolves an oxide film too fast to control.

The remover of the present invention may optionally contain zinc ions in order to increase the compactness of a zincate film formed in the subsequent zinc substitution treatment. The compounds providing zinc ions include, but are not limited to, zinc nitrate, zinc chloride, zinc oxide, zinc gluconate, zinc citrate, zinc sulfate, zinc phosphate, zinc salicylate, zinc tartrate, zinc tetrafluoroborate, zinc thiocyanate, zinc p-toluenesulfonate, zinc bromide, zinc acetate, and zinc pyrophosphate. When zinc ions are incorporated, the concentration thereof is preferably 0.01 to 50 g/L, more preferably 0.1 to 10 g/L. A concentration lower than 0.01 g/L may not contribute to a compactness of the zincate film formed in the subsequent zinc substitution step. A concentration higher than 50 g/L may cause a poor appearance of plating.

The remover mentioned above is used for surface treatment in the following way. First, it is applied to a workpiece of aluminum or aluminum alloy for surface treatment, so that silver and/or copper derived from the silver or copper compound contained in the remover substitutionally deposits on the surface of aluminum or aluminum alloy. After this step, the deposited silver and/or copper can be removed by means of an acid solution having oxidizing properties. A plating process may be performed directly on the deposited silver and/or copper or directly on the aluminum or aluminum alloy on which the deposited silver and/or copper have been removed. Alternatively, after removing the deposited silver and/or copper, a zinc substitution treatment or palladium treatment may be performed prior to a plating process.

The workpiece having aluminum or aluminum alloy may be immersed in the remover in any condition without specific restrictions. The condition for immersion may be properly established according to the thickness of the aluminum oxide film and the like. The immersion time is normally not less than 10 seconds, preferably not less 30 seconds, and is normally not more than 10 minutes, preferably not more than 5 minutes. Immersion in an excessively short time may not permit substitution to take place, resulting in incomplete removal of the oxide film. Immersion in an excessively long time may allow the remover to infiltrate through interstices of the substituted metal, resulting in dissolution of aluminum or aluminum alloy.

The immersion temperature is not specifically restricted. It is normally not lower than 25° C., preferably not lower than 30° C., and is normally not higher than 100° C., preferably not higher than 95° C. With an excessively low immersion temperature, the remover may not dissolve the oxide film. With an excessively high immersion temperature, the remover may attack other materials other than aluminum or aluminum alloy. The immersion treatment may preferably be accompanied by stirring or shaking for uniform treatment.

In the present invention, a workpiece which has aluminum or aluminum alloy at least on the surface thereof may be one which is formed entirely from aluminum or aluminum alloy, or one which is composed of a non-aluminum material, such as silicon and FRA (base material for printed circuit boards), having its surface entirely or partly covered with aluminum or aluminum alloy. The aluminum or aluminum alloy may be in any form, for example, a blank material, a rolled material, a casting material, a film, or the like. An aluminum film or an aluminum alloy film may be formed on the surface of a non-aluminum material by any methods, preferably by vapor plating such as vacuum deposition, sputtering, ion plating, or the like.

The film which is subjected to a surface treatment by the method of the present invention generally has a thickness of not less than 0.5 m, preferably not less than 5 m, so that the aluminum ground or the aluminum alloy ground remains reliably after a treatment with the remover. The upper limit of the film thickness is generally not more than 100 m, but is not limited thereto. The remover of the present invention can be effectively applied to any film having a thickness of not more than 5 m because it hardly attacks the aluminum ground or aluminum alloy ground, to which a conventional remover could not be applied because of the problem that the basis material would be too thin after the treatment.

The film mentioned above is not specifically restricted in its composition so long as it is of aluminum or aluminum alloy. Examples of aluminum alloys include Al—Si (containing 0.5 to 1.0% by weight of Si) and Al—Cu (containing 0.5 to 1.0% by weight of Cu). Such films can be preferably subjected to a surface treatment by the method according to the present invention.

The substituted metal mentioned above may be removed prior to a post-treatment. An acid solution having oxidizing properties may be used to dissolve the substituted metal in terms of reducing reactivity to aluminum or aluminum alloy as a ground. Preferable examples of the acid solution having oxidizing properties include oxidizing acids, such as nitric acid, and aqueous solutions thereof, which may contain iron nitrate, cerium(IV) sulfate, ammonium metavanadate, ammonium molybdate or the like. Also, preferable examples include non-oxidizing acids, such as sulfuric acid and hydrochloric acid, and aqueous solutions thereof containing one or more types of oxidizing agents such as hydrogen peroxide, sodium persulfate, ammonium persulfate and potassium persulfate. In the latter case, the acid acts to dissolve the substituted metal and the oxidizing agent acts to reduce reactivity to aluminum or aluminum alloy as a ground. Incidentally, preferred among the oxidizing agents is hydrogen peroxide, which is composed of hydrogen and oxygen and changes into water upon reduction. Sodium persulfate and potassium persulfate are also preferred on account of their stability and good handling properties.

When nitric acid is use as an acid (and an oxidizing agent), the concentration of nitric acid in the solution (aqueous solution) is normally not less than 200 mL/L, preferably not less than 300 mL/L, and is normally not more than 1,000 mL/L, preferably not more than 700 mL/L. With an excessively small amount of nitric acid, the acid solution may be too poor in oxidizing power to end reaction. The amount of 1,000 mL/L means that the solution is composed entirely of nitric acid.

When the solution contains an oxidizing agent, the concentration thereof is normally not less than 50 g/L, preferably not less than 75 g/L, and is normally not more than 500 g/L, preferably not more than 300 g/L. With an excessively small amount of the oxidizing agent, the acid solution is too poor in oxidizing power to end reaction. On the other hand, an excessively large amount of the oxidizing agent may lead to an economically disadvantage. The concentration of acids such as hydrochloric acid and sulfuric acid used with an oxidizing agent is normally not less than 10 g/L, preferably not less than 15 g/L, and is normally not more than 500 g/L, preferably not more than 300 g/L. An excessively low concentration of acid may hardly dissolve the substituted metal. An excessively high concentration of acid may attack other materials than aluminum or aluminum alloy. The acid solution may preferably contain a non-oxidizing acid; however, it may contain an oxidizing acid such as nitric acid or it may contain a mixture of an oxidizing acid and a non-oxidizing acid.

The dissolution treatment may take any length of time, say 5 to 300 seconds. The temperature for dissolution ranges from 10 to 40° C., for example. During the dissolution treatment, the workpiece for plating may be stationary or shaking, with the solution being optionally agitated.

The surface treatment with the remover of the present invention may be followed by plating, with an intermediate step placed between them to form the substituted metal on the surface of aluminum or aluminum alloy of the workpiece. Plating may be performed directly on the substituted metal or it may be performed after the substituted metal has been removed. In the latter case in which an oxide film is completely absent on the surface of aluminum or aluminum alloy, for example, electroless nickel plating may be performed so that aluminum as the ground material is directly substituted by nickel. Alternatively, after the substituted metal has been removed and then the surface of the workpiece is activated by zinc substitution treatment or palladium treatment, plating may be performed. Such an activating treatment preferably include zinc substitution treatment, particularly alkaline zinc substitution treatment, which permits a zinc film to be formed on the surface of aluminum or aluminum alloy, thereby allowing the plating film to firmly adhere.

The zinc substitution treatment denotes a treatment in which zinc is substitutionally deposited on the surface using a zincate-containing solution. In an alkaline zinc substitution treatment, an alkaline zincate-containing solution is used. An acidic zinc substitution treatment denotes a treatment in which zinc is substitutionally deposited on the surface using an acidic zincate-containing solution. These treatments may be performed by well-known methods. The palladium treatment denotes a treatment in which palladium is substitutionally deposited on the surface using a solution containing a palladium salt, which may be performed by well-known methods.

In the field of semiconductor devices, the above-mentioned treatment for forming a zinc film is preferably carried out as a pretreatment in order to activate the surface of aluminum thin film electrodes patterned on a wafer. The surface activation permits bumps to be formed stably by nickel plating. Although the zinc substitution treatment is liable to attack the aluminum ground or the aluminum alloy ground, the aluminum thin film electrodes is maximally protected against corrosion by using the remover of the present invention. Therefore, even though the aluminum ground or the aluminum alloy ground is somewhat attacked by the zinc substitution treatment, the aluminum thin film electrodes is sure to remain after the zinc substitution treatment.

The zinc substitution treatment may preferably be carried out once or twice, although a single treatment may be satisfactory. The remover of the present invention permits complete zinc substitution by a single treatment unlike the conventional remover which merely permits coarse zinc substitution by a single treatment. In the ensuing nickel plating processing, a good nickel film can be formed.

The surface treatment by the method of the present invention is followed by plating in any method which is not specifically restricted. Either electric plating or electroless plating may be employed.

Since electroless plating consumes less energy than electric plating, it particularly needs a good pretreatment to form a good plating layer. The method according to the present invention, in which impurities such as an aluminum oxide film are completely removed, provides a firmly adhering plating layer by electroless plating.

In addition, electroless plating is free of problems involved in electroplating, such as need for wiring, troublesome equipment assembling, inability to increase the density of the plating, and inability to form uniform plating film due to noise.

The plating metal may be selected from Cu, Ni, Au, and the like according to applications. Two or more plating layers may be formed.

EXAMPLES

The present invention will be described below in more detail with reference to the following Examples and Comparative Examples, which are not intended to restrict the scope thereof.

Examples 1 to 6 and Comparative Examples 1 to 7

Samples of the remover were prepared according to the formulation shown in Tables 1 (Examples 1 to 6) and 2 (Comparative Examples 1 to 7). In the remover was immersed a silicon board covered by sputtering with a polycrystalline aluminum layer having a thickness of 5 m and having crystal orientation planes (111) and (100), at 60° C. for 60 seconds. Incidentally, each remover was adjusted to pH 12.8. Subsequently, the workpiece was immersed in an aqueous solution of nitric acid (500 mL/L) at 25° C. for 30 seconds, thereby dissolving and removing the metal which had substitutionally deposited on the aluminum layer of the workpiece in the step of immersion in the remover. Further, the workpiece was subjected to a single zinc substitution treatment by immersion in an alkaline zincate solution. Finally, the workpiece was plated by electroless nickel plating to form a nickel film having a thickness of 1 m, and then displacement plating was performed to form a gold film having a thickness of 0.05 m thereon.

The resulting plated products were evaluated on the appearance of the plating films formed on the (111) plane and the (100) plane, respectively. In this case, the electroless nickel plating film was formed in a small thickness, and the gold film was further formed thereon. Thus, when the oxide film remained unremoved, nickel and gold were not deposited thereon and the non-plated area was left as a hole (white color). The absence of plating film (or the presence of residual oxide film) was determined by examining the white holes by contrast with gold color. The results are shown in Tables 1 and 2.

TABLE 1

| Amount of ingredients in 1 L of water | | | Example 1 | 2 | 3 | 4 | 5 | 6 |
|---|---|---|---|---|---|---|---|---|
| Remover | Alkali (base) (g/L) | TMAH | 50 | 50 | 50 | 50 | 50 | 50 |
| | | NaOH | | | | | | |
| | Solubilizing agent (g/L) | hydroxyethylethylene-diaminetriacetic acid | 10 | | 10 | | 15 | |
| | | Nitrilotriacetic acid | | 10 | | 10 | | 15 |
| | | 5,5-dimethylhydantoin | | 1 | | 1 | | |
| | | Succinimide | 1 | | 1 | | | |
| | | Barbituric acid | | | 1 | 1 | | |
| | Metal ion (g/L) | Ag (silver acetate) | 0.01 | 0.01 | 1 | 1 | | |
| | | Cu (copper sulfate) | | | | | 0.1 | 1 |
| | | Pd (palladium tetramine chloride) | | | | | | |
| | | Ni (nickel sulfate) | | | | | | |
| | | Zn (zinc oxide) | | | | | 3 | 3 |
| | | Mo (ammonium molybdate) | | | | | | |
| | Surfactant (g/L) | Polyoxyethylene ether | 5 | 1 | 5 | 1 | 5 | 1 |
| | | pH | 12.8 | 12.8 | 12.8 | 12.8 | 12.8 | 12.8 |
| Appearance of plating (○: good, x: poor) | | (111) plane | ○ | ○ | ○ | ○ | ○ | ○ |
| | | (100) plane | ○ | ○ | ○ | ○ | ○ | ○ |
| Observation under microscope (○: without holes, x: with holes | | (111) plane | ○ | ○ | ○ | ○ | ○ | ○ |
| | | (100) plane | ○ | ○ | ○ | ○ | ○ | ○ |

TABLE 2

| Amount of ingredients in 1 L of water | | | Comparative Example 1 | 2 | 3 | 4 | 5 | 6 | 7 |
|---|---|---|---|---|---|---|---|---|---|
| Remover | Alkali (base) (g/L) | TMAH | | 50 | 50 | 50 | 50 | | |
| | | NaOH | 50 | | | | | 50 | 50 |
| | Solubilizing agent (g/L) | hydroxyethylethylene-diaminetriacetic acid | 10 | | 10 | | 10 | 10 | 10 |
| | | Nitrilotriacetic acid | | 10 | | 10 | | | |
| | | 5,5-dimethylhydantoin | | | | | | 1 | |
| | | Succinimide | | | | | | | |
| | | Barbituric acid | | | | | | | 1 |
| | Metal ion (g/L) | Ag (silver acetate) | | | | | | 1 | 1 |
| | | Cu (copper sulfate) | 1 | | | | | | |
| | | Pd (palladium tetramine chloride) | | 1 | | | | | |
| | | Ni (nickel sulfate) | | | 1 | | | | |
| | | Zn (zinc oxide) | | | | 1 | | | |
| | | Mo (ammonium molybdate) | | | | | 1 | | |
| | Surfactant (g/L) | Polyoxyethylene ether | 5 | 5 | 5 | 5 | 5 | 5 | 5 |
| | | pH | 12.8 | 12.8 | 12.8 | 12.8 | 12.8 | 12.8 | 12.8 |
| Appearance of plating (○: good, x: poor) | | (111) plane | ○ | ○ | ○ | ○ | ○ | ○ | ○ |
| | | (100) plane | x | x | x | x | x | x | x |
| Observation under microscope (○: without holes, x: with holes | | (111) plane | ○ | ○ | ○ | ○ | ○ | ○ | ○ |
| | | (100) plane | x | x | x | x | x | x | x |

Japanese Patent Application Nos. 2010-142787 and 2011-106928 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for surface treatment of aluminum or aluminum alloy, comprising:

immersing a workpiece having aluminum or aluminum alloy at least on the surface thereof in the aluminum oxide film remover comprising: a silver ion, a solubilizing agent for the silver ion, and a quaternary ammonium hydroxide compound having an alkyl group and/or hydroxyalkyl group of 1 to 4 carbon atoms, said remover having a pH value of 10 to 13.5; and depositing the silver contained in the remover on the surface of aluminum or aluminum alloy while removing the aluminum oxide film, wherein the surface of the aluminum or aluminum alloy comprises a (100) plane.

2. The method for surface treatment of aluminum or aluminum alloy of claim 1, wherein the workpiece is one which has an aluminum film or an aluminum alloy film formed on the surface of a non-aluminum material.

3. The method for surface treatment of aluminum or aluminum alloy of claim 1, wherein the step of depositing silver is followed by an additional step of removing the deposited metal by an acid solution having oxidizing properties.

4. The method for surface treatment of aluminum or aluminum alloy of claim 3, wherein the step of removing the deposited metal by an acid solution having oxidizing properties is followed by a step of subjecting the aluminum or aluminum alloy to a zinc substitution treatment or a palladium treatment, and a subsequent step of plating.

5. The method for surface treatment of aluminum or aluminum alloy of claim 3, wherein the step of removing the deposited metal by an acid solution having oxidizing properties is followed by a step of plating directly on the aluminum or aluminum alloy.

6. The method for surface treatment of aluminum or aluminum alloy of claim 1, wherein the aluminum oxide film remover further comprises a surfactant.

7. The method for surface treatment of aluminum or aluminum alloy of claim 1, wherein the aluminum oxide film remover further comprises zinc ions.

8. The method for surface treatment of aluminum or aluminum alloy of claim 1, wherein the step of depositing silver is followed by an additional step of forming a plating layer thereon.

9. The method for surface treatment of aluminum or aluminum alloy of claim 1, wherein the solubilizing agent for the silver ion comprises a hydantoin compound, a barbituric acid compound or an imide compound.

10. A method for surface treatment of aluminum or aluminum alloy, comprising:

immersing a workpiece having aluminum or aluminum alloy at least on the surface thereof in the aluminum oxide film remover comprising: a copper ion, a zinc ion, a solubilizing agent for the copper ion, and a quaternary ammonium hydroxide compound having an alkyl group and/or hydroxyalkyl group of 1 to 4 carbon atoms, said remover having a pH value of 10 to 13.5; and depositing the copper contained in the remover on the surface of aluminum or aluminum alloy while removing the aluminum oxide film, wherein the surface of the aluminum or aluminum alloy comprises a (100) plane.

11. The method for surface treatment of aluminum or aluminum alloy of claim 10, wherein the workpiece is one which has an aluminum film or an aluminum alloy film formed on the surface of a non-aluminum material.

12. The method for surface treatment of aluminum or aluminum alloy of claim 10, wherein the step of depositing copper is followed by an additional step of forming a plating layer thereon.

13. The method for surface treatment of aluminum or aluminum alloy of claim 10, wherein the step of depositing copper is followed by an additional step of removing the deposited metal by an acid solution having oxidizing properties.

14. The method for surface treatment of aluminum or aluminum alloy of claim 13, wherein the step of removing the deposited metal by an acid solution having oxidizing properties is followed by a step of subjecting the aluminum or aluminum alloy to a zinc substitution treatment or a palladium treatment, and a subsequent step of plating.

15. The method for surface treatment of aluminum or aluminum alloy of claim 13, wherein the step of removing the deposited metal by an acid solution having oxidizing properties is followed by a step of plating directly on the aluminum or aluminum alloy.

* * * * *